US008490703B2

(12) United States Patent
Patten et al.

(10) Patent No.: US 8,490,703 B2
(45) **Date of Patent: *Jul. 23, 2013**

(54) CORRUGATED HEATING CONDUIT AND METHOD OF USING IN THERMAL EXPANSION AND SUBSIDENCE MITIGATION

(75) Inventors: James W. Patten, Sandy, UT (US); Todd Dana, Park City, UT (US)

(73) Assignee: Red Leaf Resources, Inc, South Jordan, UT (US)

( * ) Notice: Subject to any disclaimer, the term of this patent is extended or adjusted under 35 U.S.C. 154(b) by 645 days.

This patent is subject to a terminal disclaimer.

(21) Appl. No.: 12/703,638

(22) Filed: Feb. 10, 2010

(65) Prior Publication Data

US 2010/0206518 A1 Aug. 19, 2010

Related U.S. Application Data

(60) Provisional application No. 61/152,150, filed on Feb. 12, 2009.

(51) Int. Cl.
*C10G 1/04* (2006.01)

(52) U.S. Cl.
USPC ..... 166/302; 208/106; 208/400

(58) Field of Classification Search
USPC ..... 208/106, 390, 400; 166/302
See application file for complete search history.

(56) References Cited

U.S. PATENT DOCUMENTS

| | | | |
|---|---|---|---|
| 1,919,636 | A | 7/1933 | Karrick |
| 2,481,051 | A | 9/1949 | Uren |
| 3,661,423 | A | 5/1972 | Garrett |
| 3,954,140 | A | 5/1976 | Hendrick |
| 4,017,119 | A | 4/1977 | Lewis |
| 4,096,912 | A | 6/1978 | Lewis et al. |
| 4,106,814 | A | 8/1978 | French |
| 4,133,580 | A | 1/1979 | French |
| 4,219,237 | A | 8/1980 | Sisemore |

(Continued)

FOREIGN PATENT DOCUMENTS

| | | | |
|---|---|---|---|
| JP | 07/310858 | | 11/1995 |
| WO | WO2009/006687 | A1 * | 1/2009 |

OTHER PUBLICATIONS

US PCT Application PCT/US2010/023935; filed Feb. 11, 2010; James W. Patten.

(Continued)

*Primary Examiner* — John Kreck
(74) *Attorney, Agent, or Firm* — Thorpe North & Western LLP

(57) ABSTRACT

A method of maintaining the structural integrity of heating conduit used to heat a permeable body of hydrocarbonaceous material enclosed within a constructed permeability control infrastructure. The method includes obtaining a heating conduit with corrugated walls and configured for transporting a heat transfer fluid, burying the heating conduit at a depth within the permeable body of hydrocarbonaceous material and with an inlet end extending from the boundary of the constructed permeability control infrastructure, operably coupling the inlet end of the heating conduit to a heat source of the heat transfer fluid, and passing the heat transfer fluid through the heating conduit to transfer heat from the heat transfer fluid to the permeable body, with the corrugations in the corrugated walls mitigating longitudinal axis thermal expansion of the heating conduit and allowing the heating conduit to conformably bend in response to subsidence of the permeable body.

21 Claims, 6 Drawing Sheets

U.S. PATENT DOCUMENTS 4,234,230 A 11/1980 Weichman
4,241,952 A 12/1980 Ginsburgh
4,266,612 A 5/1981 French
4,266,826 A 5/1981 French
4,279,291 A * 7/1981 Lambert ..... 165/45
4,294,563 A 10/1981 Kilburn
4,415,365 A 11/1983 Spars et al.
4,423,907 A 1/1984 Ridley
4,424,021 A 1/1984 Merrill, Jr.
4,430,195 A 2/1984 Oltrogge
4,440,446 A 4/1984 Hutchins
4,452,689 A 6/1984 Russum
4,454,915 A 6/1984 York et al.
4,502,920 A 3/1985 Edwards
4,854,372 A 8/1989 Sakaya
4,984,594 A 1/1991 Vinegar et al.
5,024,487 A 6/1991 Woestemeyer et al.
5,076,727 A 12/1991 Johnson et al.
5,114,497 A 5/1992 Johnson et al.
5,190,405 A 3/1993 Vinegar et al.
5,193,934 A 3/1993 Johnson et al.
5,217,578 A * 6/1993 Taciuk et al. ..... 202/100
5,221,827 A 6/1993 Marsden et al.
5,229,583 A 7/1993 van Egmond et al.
5,244,310 A 9/1993 Johnson
5,271,693 A 12/1993 Johnson et al.
5,318,116 A 6/1994 Vinegar et al.
5,340,467 A 8/1994 Gregoli et al.
5,372,708 A 12/1994 Gewertz
5,553,189 A 9/1996 Stegemeier et al.
5,656,239 A 8/1997 Stegemeier et al.
5,660,500 A 8/1997 Marsden, Jr. et al.
5,674,424 A 10/1997 Iben et al.
5,868,202 A 2/1999 Hsu
5,997,214 A 12/1999 de Rouffignac et al.
6,102,622 A 8/2000 Vinegar et al.
6,110,359 A 8/2000 Davis et al.
6,409,226 B1 6/2002 Slack
6,419,423 B1 7/2002 Vinegar et al.
6,485,232 B1 11/2002 Vinegar et al.
6,543,535 B2 4/2003 Converse et al.
6,543,539 B1 4/2003 Vinegar et al.
6,632,047 B2 10/2003 Vinegar et al.
6,732,796 B2 5/2004 Vinegar et al.
6,811,683 B2 11/2004 Davis et al.
6,824,328 B1 11/2004 Vinegar et al.
6,854,929 B2 2/2005 Vinegar et al.
6,875,356 B2 4/2005 Perriello
6,881,009 B2 4/2005 Stegemeier et al.
6,902,138 B2 6/2005 Vantouroux
6,918,443 B2 7/2005 Wellington et al.
6,923,257 B2 8/2005 Wellington et al.
6,929,330 B2 8/2005 Drake et al.
6,951,247 B2 10/2005 de Rouffignac et al.
6,962,466 B2 11/2005 Vinegar et al.
6,991,033 B2 1/2006 Wellington et al.
7,004,247 B2 2/2006 Cole et al.
7,004,251 B2 2/2006 Ward et al.
7,004,678 B2 2/2006 Stegemeier et al.
7,032,660 B2 4/2006 Vinegar et al.
7,040,397 B2 5/2006 de Rouffignac et al.
7,040,399 B2 5/2006 Wellington et al.
7,048,051 B2 5/2006 McQueen
7,051,811 B2 5/2006 de Rouffignac et al.
7,066,254 B2 6/2006 Vinegar et al.
7,070,758 B2 7/2006 Peterson
7,073,578 B2 7/2006 Vinegar et al.
7,077,198 B2 7/2006 Vinegar et al.
7,077,199 B2 7/2006 Vinegar et al.
7,090,013 B2 8/2006 Wellington
7,091,460 B2 8/2006 Kinzer
7,114,566 B2 10/2006 Vinegar et al.
7,121,342 B2 10/2006 Vinegar et al.
7,534,926 B2 5/2009 Stegemeier et al.
7,862,705 B2 * 1/2011 Dana et al. ..... 208/106
2004/0211569 A1 10/2004 Vinegar et al.
2006/0213657 A1 9/2006 Berchenko et al.
2007/0000662 A1 1/2007 Symington et al.
2007/0023186 A1 2/2007 Kaminsky et al.
2008/0190813 A1 8/2008 Dana
2008/0190815 A1 8/2008 Dana
2008/0190816 A1 8/2008 Dana
2008/0190818 A1 8/2008 Dana
2009/0250380 A1 10/2009 Dana

OTHER PUBLICATIONS

Alternative Methods for Fluid Delivery and Recovery; Manual; Sep. 1994; United States Environmental Protection Agency; 87 pgs.
U.S. Appl. No. 12/704,440, filed Feb. 11, 2010, Todd Dana.
U.S. Appl. No. 12/702,899, filed Feb. 9, 2010, Todd Dana.
U.S. Appl. No. 12/703,560, filed Feb. 10, 2010, Todd Dana.
U.S. Appl. No. 12/704,596, filed Feb. 12, 2010, Todd Dana.
U.S. Appl. No. 12/701,073, filed Feb. 5, 2010, Todd Dana.
U.S. Appl. No. 12/701,141, filed Feb. 5, 2010, Todd Dana.
U.S. Appl. No. 12/701,156, filed Feb. 5, 2010, Todd Dana.

* cited by examiner

CORRUGATED HEATING CONDUIT AND METHOD OF USING IN THERMAL EXPANSION AND SUBSIDENCE MITIGATION

RELATED APPLICATIONS

This application claims the benefit of U.S. Provisional Application No. 61/152,150, filed Feb. 12, 2009, and entitled "Corrugated Heating Conduit and Method of Using in Thermal Expansion and Subsidence Mitigation," which application is incorporated by reference in its entirety herein.

BACKGROUND

Global and domestic demand for fossil fuels continues to rise despite price increases and other economic and geopolitical concerns. As such demand continues to rise, research and investigation into finding additional economically viable sources of fossil fuels correspondingly increases. Historically, many have recognized the vast quantities of energy stored in oil shale, coal and tar sand deposits, for example. However, these sources remain a difficult challenge in terms of economically competitive recovery. Canadian tar sands have shown that such efforts can be fruitful, although many challenges still remain, including environmental impact, product quality, production costs and process time, among others.

Estimates of world-wide oil shale reserves range from two to almost seven trillion barrels of oil, depending on the estimating source. Regardless, these reserves represent a tremendous volume and remain a substantially untapped resource. A large number of companies and investigators continue to study and test methods of recovering oil from such reserves. In the oil shale industry, methods of extraction have included underground rubble chimneys created by explosions, in-situ methods such as In-Situ Conversion Process (ICP) method (Shell Oil), and heating within steel fabricated retorts. Other methods have included in-situ radio frequency methods (microwaves), and "modified" in-situ processes wherein underground mining, blasting and retorting have been combined to make rubble out of a formation to allow for better heat transfer and product removal Among typical oil shale processes, all face tradeoffs in economics and environmental concerns. No current process alone satisfies economic, environmental and technical challenges. Moreover, global warming concerns give rise to additional measures to address carbon dioxide ($CO_2$) emissions which are associated with such processes. Methods are needed that accomplish environmental stewardship, yet still provide a high-volume cost-effective oil production.

Below ground in-situ concepts emerged based on their ability to produce high volumes while avoiding the cost of mining. While the cost savings resulting from avoiding mining can be achieved, the in-situ method requires heating a formation for a longer period of time due to the extremely low thermal conductivity and high specific heat of solid oil shale. Perhaps the most significant challenge for any in-situ process is the uncertainty and long term potential of water contamination that can occur with underground freshwater aquifers. In the case of Shell's ICP method, a "freeze wall" is used as a barrier to keep separation between aquifers and an underground treatment area. Although this is possible, no long term analysis has proven for extended periods to guarantee the prevention of contamination. Without guarantees and with even fewer remedies should a freeze wall fail, other methods are desirable to address such environmental risks.

For this and other reasons, the need remains for methods and systems which can provide improved recovery of hydrocarbons from suitable hydrocarbon-containing materials, which have acceptable economics and avoid the drawbacks mentioned above.

SUMMARY

A method is provided for maintaining the structural integrity of buried conduit, such as heating conduit used to heat a permeable body of hydrocarbonaceous material enclosed within a constructed permeability control infrastructure. The method includes obtaining a heating conduit having corrugated walls and which is configured for transporting a heat transfer fluid, and burying the heating conduit at a depth within the permeable body of hydrocarbonaceous material, and with an inlet end extending from the boundary of the constructed permeability control infrastructure. The method also includes operably coupling the inlet end of the heating conduit a source of the heat transfer fluid, and passing the heat transfer fluid through the heating conduit to transfer heat from the heat transfer fluid to the permeable body while allowing the corrugated walls to compress axially and mitigate restrained thermal expansion along the longitudinal axis of the heating conduit, and to conformably bend and mitigate lateral stresses caused by subsidence of the permeable body.

In accordance with another representative embodiment broadly described herein, a heating conduit system is provided for transferring heat from a heat transfer fluid to a permeable body of hydrocarbonaceous material contained within a constructed permeability control infrastructure. The system includes a constructed permeability control infrastructure and a permeable body of hydrocarbonaceous material contained within the control infrastructure. The system also includes heating conduit that is configured for transporting the heat transfer fluid and which is buried at a depth within the permeable body having corrugated wall with at least one inlet end extending from a boundary of the control infrastructure. The system further includes a source of the heat transfer fluid operably coupled to the at least one inlet end, so that passing the heat transfer fluid through the heating conduit to transfer heat to the permeable body allows the corrugated walls of at least one portion of the buried heating conduit to axially compress under the effects of thermal expansion, and the corrugated walls of at least one other portion of the buried heating conduit to conformably bend in response to subsidence of the permeable body.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments and are not, therefore, to be considered limiting of its scope. And furthermore, it will be readily appreciated that the components, as generally described and illustrated in the figures herein, could be arranged and designed in a wide variety of different configurations.

DETAILED DESCRIPTION OF EXEMPLARY EMBODIMENTS

Figure 1:
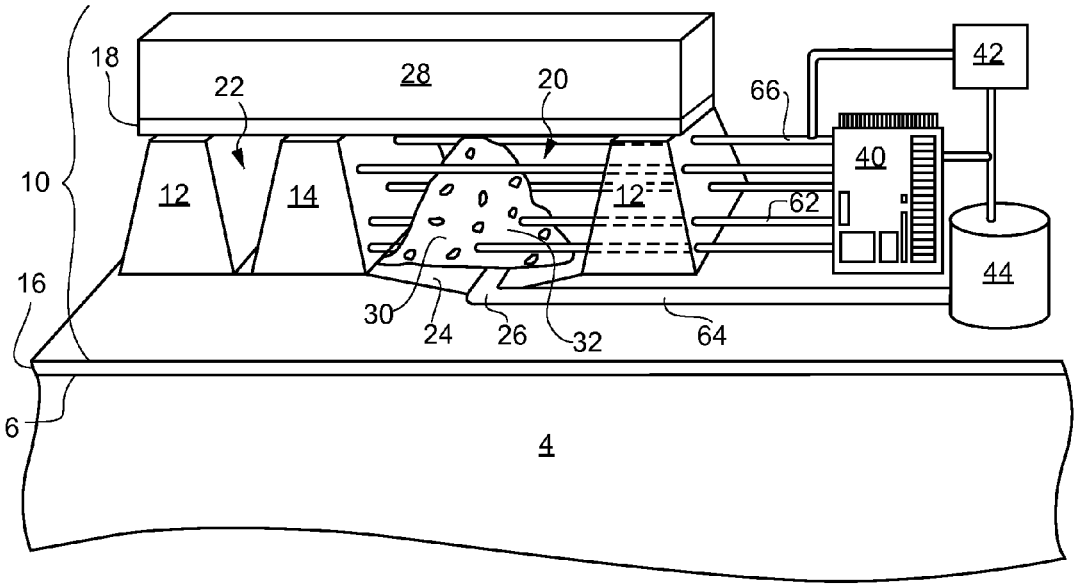
FIG. 1 illustrates a partial cutaway, side schematic view of a constructed permeability control infrastructure that includes a permeable body of hydrocarbonaceous material, a heat source and interconnecting piping, in accordance with one embodiment.

Reference will now be made to exemplary embodiments and specific language will be used herein to describe the same. It will nevertheless be understood that no limitation of the scope of the present invention is thereby intended. Alterations and further modifications of the inventive features described herein, and additional applications of the principles of the invention as described herein, which would occur to one skilled in the relevant art and having possession of this disclosure, are to be considered within the scope of the invention. Further, before particular embodiments are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

Definitions

In describing and claiming the present invention, the following terminology will be used.

The singular forms "a", "an", and "the" include plural references unless the context clearly dictates otherwise. Thus, for example, reference to "a wall" includes reference to one or more of such structures, "a permeable body" includes reference to one or more of such materials, and "a heating step" refers to one or more of such steps.

As used herein, "conduits" refers to any passageway along a specified distance which can be used to transport materials and/or heat from one point to another point. Although conduits can generally be circular pipes, other non-circular conduits can also be useful, e.g. oblong, rectangular, etc. Conduits can advantageously be used to either introduce fluids into or extract fluids from the permeable body, convey heat transfer, and/or to transport radio frequency devices, fuel cell mechanisms, resistance heaters, or other devices.

As used herein, "longitudinal axis" refers to the long axis or centerline of a conduit or passage.

As used herein, "transverse" refers to a direction that cuts across a referenced plane or axis at an angle ranging from perpendicular to about 45 degrees off the referenced plane or axis.

As used herein, "conformably bend" refers to bending which at least partially follows subsidence movement of the permeable body during heating. Such bending allows for lateral deflection of the conduit while reducing the risk of rupturing the walls of the conduit.

As used herein, "longitudinal axis thermal expansion" refers to an accordion effect along the length of the corrugated conduit. When corrugations are circumferential, e.g. spiral or circular, as the conduit material expands, the corrugations allow the overall length of the conduit to increase if the conduit is free to move at one or both ends. If the conduit is fixed along its length, however, the corrugations allow the longitudinal expansion to be absorbed at the individual corrugations. Thus, a corrugated conduit can be designed to eliminate linear expansion or at least reduce the stresses associated with restrained linear expansion by allowing corrugations to permit flexing without loss of conduit wall integrity.

As used herein, "apertures" refers to holes, slots, pores or openings, etc., in the walls or joints of the conduit which allow the flow of fluid, whether gases or liquids, between the interior of conduit and the immediately adjacent environment. The flow can be outwards towards the adjacent environment if the pressure inside the conduit is greater than the outside pressure. The flow can also be inwards toward the interior of the conduit if the pressure inside the conduit is less than the outside pressure.

As used herein, "constructed infrastructure" refers to a structure which is substantially entirely man made, as opposed to freeze walls, sulfur walls, or other barriers which are formed by modification or filling pores of an existing geological formation.

The constructed permeability control infrastructure is often substantially free of undisturbed geological formations, although the infrastructure can be formed adjacent or in direct contact with an undisturbed formation. Such a control infrastructure can be unattached or affixed to an undisturbed formation by mechanical means, chemical means or a combination of such means, e.g. bolted into the formation using anchors, ties, or other suitable hardware.

As used herein, "comminuted" refers to breaking a formation or larger mass into pieces. A comminuted mass can be rubbilized or otherwise broken into fragments.

As used herein, "hydrocarbonaceous material" refers to any hydrocarbon-containing material from which hydrocarbon products can be extracted or derived. For example, hydrocarbons may be extracted directly as a liquid, removed via solvent extraction, directly vaporized or otherwise removed from the material. However, many hydrocarbonaceous materials contain kerogen or bitumen which is converted to a hydrocarbon product through heating and pyrolysis. Hydrocarbonaceous materials can include, but is not limited to, oil shale, tar sands, coal, lignite, bitumen, peat, and other organic materials.

As used herein, "impoundment" refers to a structure designed to hold or retain an accumulation of fluid and/or solid moveable materials. An impoundment generally derives at least a substantial portion of foundation and structural support from earthen materials. Thus, the control walls do not always have independent strength or structural integrity apart from the earthen material and/or formation against which they are formed.

As used herein, "permeable body" refers to any mass of comminuted hydrocarbonaceous material having a relatively high permeability which exceeds permeability of a solid undisturbed formation of the same composition. Suitable permeable bodies can have greater than about 10% void space and typically have void space from about 30% to 50%, although other ranges may be suitable. Allowing for high permeability facilitates, for example, through the incorporation of large irregularly shaped particles, heating of the body through convection as the primary heat transfer while also substantially reducing costs associated with crushing to very small sizes, e.g. below about 1 to about 0.5 inch.

As used herein, "wall" refers to any constructed feature having a permeability control contribution to confining material within an encapsulated volume defined at least in part by control walls. Walls can be oriented in any manner such as vertical, although ceilings, floors and other contours defining the encapsulated volume can also be "walls" as used herein.

As used herein, "mined" refers to a material which has been removed or disturbed from an original stratographic or geological location to a second and different location or returned to the same location. Typically, mined material can be produced by rubbilizing, crushing, explosively detonating, drilling, or otherwise removing material from a geologic formation.

As used herein, "bulk convective flow pattern" refers to convective heat flow which spans a majority of the permeable body. Generally, convective flow is generated by orienting one or more conduits or heat sources in a lower or base portion of a defined volume. By orienting the conduits in this manner, heated fluids can flow upwards and cooled fluids flow back down along a substantial majority of the volume occupied by the permeable body of hydrocarbonaceous material in a recirculating pattern.

As used herein, "substantially stationary" refers to nearly stationary positioning of materials with a degree of allowance for subsidence, expansion due to the popcorn effect, and/or settling as hydrocarbons are removed from the hydrocarbonaceous material from within the enclosed volume to leave behind lean material. In contrast, any circulation and/or flow of hydrocarbonaceous material such as that found in fluidized beds or rotating retorts involves highly substantial movement and handling of hydrocarbonaceous material.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Corrugated Heating Conduit

Illustrated in FIGS. 1-8 are several representative embodiments of a corrugated heating conduit system and a method of using the same for thermal expansion and subsidence mitigation. The heating conduit can be buried inside a permeable body of mined hydrocarbonaceous material, such as oil shale, tar sands, coal, etc., that is contained within a constructed permeability control infrastructure, and from which hydrocarbon products are intended to be extracted. The hydrocarbon products can be extracted by passing a heat transfer fluid, such as hot air, hot exhaust gases, steam, hydrocarbon vapors and/or hot liquids, into or through the buried heating conduit to heat the hydrocarbonaceous material to temperature levels sufficient to remove hydrocarbons therefrom. The heat transfer fluid can be isolated from the permeable body or optionally be allowed to convectively flow through interstitial volumes in the permeable body. In order for the extraction process to be effective, it can be desirable to raise the temperature of the permeable body to between 200 degrees and 900 degrees Fahrenheit to initiate pyrolysis. Consequently, the temperature of the heat transfer fluid within the heating conduit can be elevated to even higher temperatures, such as 1000 degrees Fahrenheit or above, to maintain a constant flow of heat away from the heat transfer fluid and into the permeable body.

It has been discovered that during the heating and/or pyrolysis processes the permeable body of hydrocarbonaceous material can remain substantially stationary in the lateral directions, but over time can undergo significant vertical subsidence movement and settling as the hydrocarbons are released to flow downwards as a liquid or upwards as a gas. The vertical subsidence of the permeable body can impart transverse sheer stresses to the structures buried within the permeable body, leading to a build-up of harmful lateral stresses in the walls and joints of the heating conduits or other conduits. At the same time, with sufficient overlying weight the comminuted, particulate nature of the mined hydrocarbonaceous material can act to restrain any stress-relieving longitudinal thermal expansion of the conduit as it is heated to the elevated temperatures. When focused at localized stress-concentration points, the sheer-induced stresses and heat-induced stresses can combine together to exceed the material limits of the conduit walls and joints, resulting in a rupture that allows the heating fluid to escape. It is desirable, therefore, to maintain the structural integrity of the heating conduit buried within the subsiding permeable body through mitigation of the harmful thermal expansion and the subsidence-induced effects experienced by the conduit.

Exemplary embodiments of a constructed permeability control infrastructure, and the permeable body of hydrocarbonaceous material contained within its substantially encapsulated volume, are described in more detail in commonly-owned and co-pending U.S. patent application Ser. No. 12/028,569, filed Feb. 8, 2008, and entitled "Methods Of Recovering Hydrocarbons From Hydrocarbonaceous Material Using A Constructed Infrastructure And Associated Systems," which application is incorporated by reference in its entirety herein.

In accordance with one embodiment, FIG. 1 provides a partial cutaway, side schematic view of a constructed permeability control infrastructure or impoundment 10, a permeable body 30 of hydrocarbonaceous material 32, a heat source 40, and interconnecting piping 62, 64, and 66. In the embodiment shown, the existing grade 4 is used primarily as support for an impermeable floor layer 16. Exterior capsule impoundment side walls 12 can provide containment and can, but need not be, subdivided by interior walls 14. Subdividing can create separate containment capsules 22 within a greater capsule containment 20 of the impoundment 10 which can be any geometry, size or subdivision.

The sidewalls 12 and 14, as well as the impermeable cap 18 and impermeable floor 16 layers, can comprise the permeability control impoundment 10 that defines the encapsulated volume 20, and can be formed of any suitable material. For instance, the sidewalls 12 and 14 of the impoundment 10 can also be self-supporting, wherein the tailings berms, walls, and floors are be compacted and engineered for structure as well as substantial impermeability (e.g. sufficient to prevent uncontrolled escape of fluids from the impoundment). Furthermore, the impermeable cap layer 18 can be used to prevent uncontrolled escape of volatiles and gases, and to direct the gases and vapors to appropriate gas collection outlets 66. Similarly, an impermeable floor layer 16 can be used to contain and direct collected liquids to a suitable outlet such the drain system 26 to remove liquid products from lower regions of the impoundment. Although impermeable side walls can be desirable in some embodiments, such are not always required. Having permeable side walls may allow some small egress of gases and/or liquids from the impoundment. Further, one or more walls can be multi-layered structures to provide permeability control, thermal insulation and/or other features to the system.

Once wall structures 12 and 14 have been constructed above a constructed and impermeable floor layer 16, which commences from ground surface 6, the mined hydrocarbonaceous material 32 (which may be crushed or classified according to size or hydrocarbon richness), can be placed in layers upon (or next to) pre-positioned tubular heating pipes or conduit 62, fluid drainage pipes 64 and/or gas gathering or injection pipes 66. These pipes can be oriented and designed in any optimal flow pattern, angle, length, size, volume, intersection, grid, wall sizing, alloy construction, perforation design, injection rate, and extraction rate. In some cases, pipes such as those used for heat transfer can be connected to, recycled through or derive heat from a heat source 40. Alternatively, or in combination with, recovered gases can be condensed by a condenser 42. Heat recovered by the condenser can be optionally used to supplement heating of the permeable body or for other process needs.

Heat source 40 can derive or create heat from any suitable heat source including, but not limited to, fuel cells (e.g. solid oxide fuel cells, molten carbonate fuel cells and the like), solar sources, wind sources, hydrocarbon liquid or gas combustion heaters, geothermal heat sources, nuclear power plant, coal fired power plant, radio frequency generated heat, wave energy, flameless combustors, natural distributed combustors, or any combination thereof. In some cases, electrical resistive heaters or other heaters can be used, although fuel cells and combustion-based heaters are particularly effective. In some locations, geothermal water can be circulated to the surface and directed into the infrastructure in adequate amounts to heat the permeable body.

In one embodiment, heating of the permeable body 30 can be accomplished by convective heating from hydrocarbon combustion. Of particular interest is hydrocarbon combustion performed under stoichiometric conditions of fuel to oxygen. Stoichiometric conditions can allow for significantly increased heat gas temperatures. Stoichiometric combustion can employ but does not generally require a pure oxygen source which can be provided by known technologies including, but not limited to, oxygen concentrators, membranes, electrolysis, and the like. In some embodiments oxygen can be provided from air with stoichiometric amounts of oxygen and hydrogen. Combustion off gas can be directed to an ultra-high temperature heat exchanger, e.g. a ceramic or other suitable material having an operating temperature above about 2500° F. Air obtained from ambient or recycled from other processes can be heated via the ultra high temperature heat exchanger and then sent to the impoundment for heating of the permeable body. The combustion off gases can then be sequestered without the need for further separation, i.e. because the off gas is predominantly carbon dioxide and water.

A liquid or gas heat transfer fluid can transfer heat from the heat source 40, through heating conduit 62 and into the permeable body 30 of hydrocarbonaceous material 32.

The liquids or gases extracted from capsule impoundment treatment area 20 or 22 can be stored in a nearby holding tank 44 or within a capsule containment 20 or 22. For example, the impermeable floor layer 16 can include a sloped area 24 which directs liquids towards drain system 26, from which liquids are directed to the holding tank 44 through drain piping 64.

As placed rubble material 32 fills the capsule treatment area 20 or 22, the permeable body 30 can also become the ceiling support for engineered impermeable cap layer 18, which may include an engineered fluid and gas barrier. Above cap layer 18, fill material 28 can be added to form a top layer that can create lithostatic pressure upon the capsule treatment areas 20 or 22. Covering the permeable body 30 with a compacted fill layer 28 sufficient to create an increased lithostatic pressure within the permeable body 30 can be useful in further increasing hydrocarbon product quality. The compacted fill layer 28 can substantially cover the permeable body 30, while the permeable body 30 in return can substantially support the compacted fill layer 28.

Figure 2:
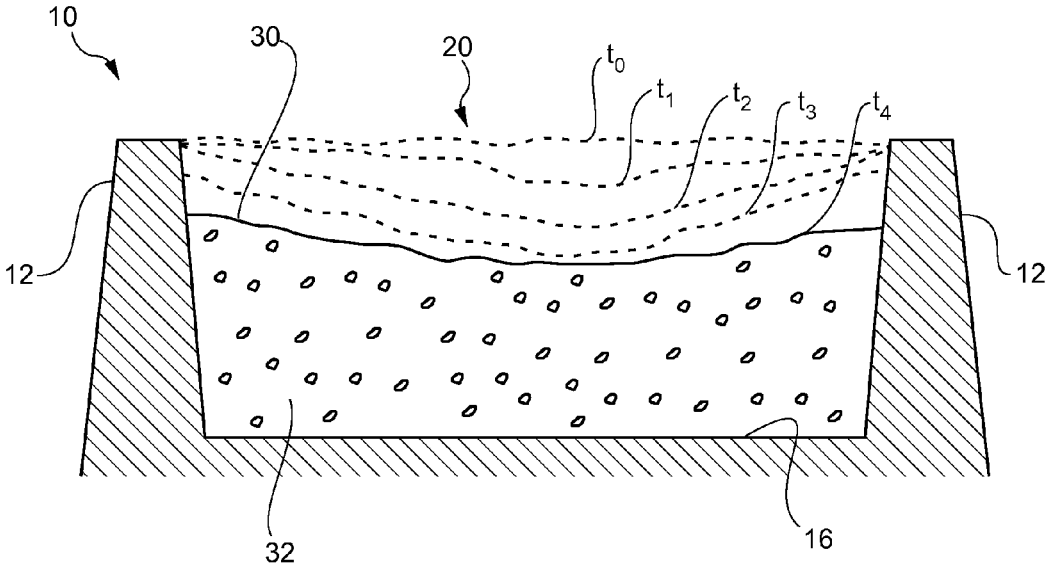
FIG. 2 illustrates a side sectional view of a subsiding permeable body of hydrocarbonaceous material contained within a constructed permeability control infrastructure, in accordance with the embodiment of FIG. 1.

FIG. 2 is an illustration of the permeable body 30 of hydrocarbonaceous material 32 contained within the constructed permeability control infrastructure or impoundment 10. The permeable body can substantially fill the containment capsule or volume 20 defined by the side walls 12, the impermeable floor layer 16 and the impermeable cap layer (not shown). As stated above, it has been discovered that during the heating process that the permeable body of hydrocarbonaceous material can undergo significant vertical subsidence movement and settling as the hydrocarbons are released. For instance, during the filling stage and prior to commencement of the heating process, the encapsulated volume 20 can be substantially filled with hydrocarbonaceous material 32 so that top surface $t_0$ of the permeable body 30 is substantially level with the top of the side walls 12 to maximize the amount of hydrocarbonaceous material included in the batch process.

Temperature gradients can begin to develop with the introduction of heat into the permeable body, with the center and upper regions becoming hotter than the side and bottom edges adjacent the unheated boundaries of the containment capsule 20. Hydrocarbons can begin to flow more readily from the hotter regions, resulting in the initial subsidence of the top surface having the greatest movement in the center regions, to the $t_1$ position. The period of time necessary to reach the $t_1$ position can vary greatly, however, depending on the composition and configuration of the hydrocarbonaceous material 32, the size of the permeable body 30, the method of heating and heat rate provided by the heating conduit system, the ambient environment and insulating boundary conditions, etc., and can range from a few days to a few months. It has been observed that the hydrocarbon products can substantially begin to remove when hydrocarbonaceous material 32 reaches a temperature of about 600 degrees F.

As the higher temperatures spread towards the edges of the containment capsule 20, the top surface of the permeable body 30 can continue to subside through the $t_2$ and $t_3$ positions, following a pattern in which the center regions can still experience more vertical movement than the edges. However, continuous heating can eventually raise the temperature of the hydrocarbonaceous material 32 to the critical extraction points throughout the entire permeable body, causing even the material adjacent the boundaries of the impoundment 10 to liberate hydrocarbons. At that point the outer regions can also undergo significant vertical subsidence until the top surface reaches the $t_4$ position.

The amount of vertical subsidence experienced by the permeable body 30 can vary greatly, depending upon composition of the hydrocarbonaceous material 32 and it initial configuration. Although exaggerated in FIG. 2 for illustrative effect, the amount of vertical movement of the top surface can sometimes range between 5% and 25% of the initial vertical height of the body, with a subsidence of 12%-16% being common for oil shale. In one oil shale example, about 30 inches of subsidence was realized in a 16 foot deep permeable body. As can be appreciated by one of skill in the art, maintaining the structural integrity of any conduits buried within such a subsiding permeable body and its connection with impoundment walls and/or a heat source located outside the constructed permeability control structure can be challenging.

The following description is particularly exemplified with respect to heating conduits; however it will be understood that the corrugations and configurations can also be applied to cooling conduits, collection conduits, and other conduits embedded within the permeable body.

Figure 3:
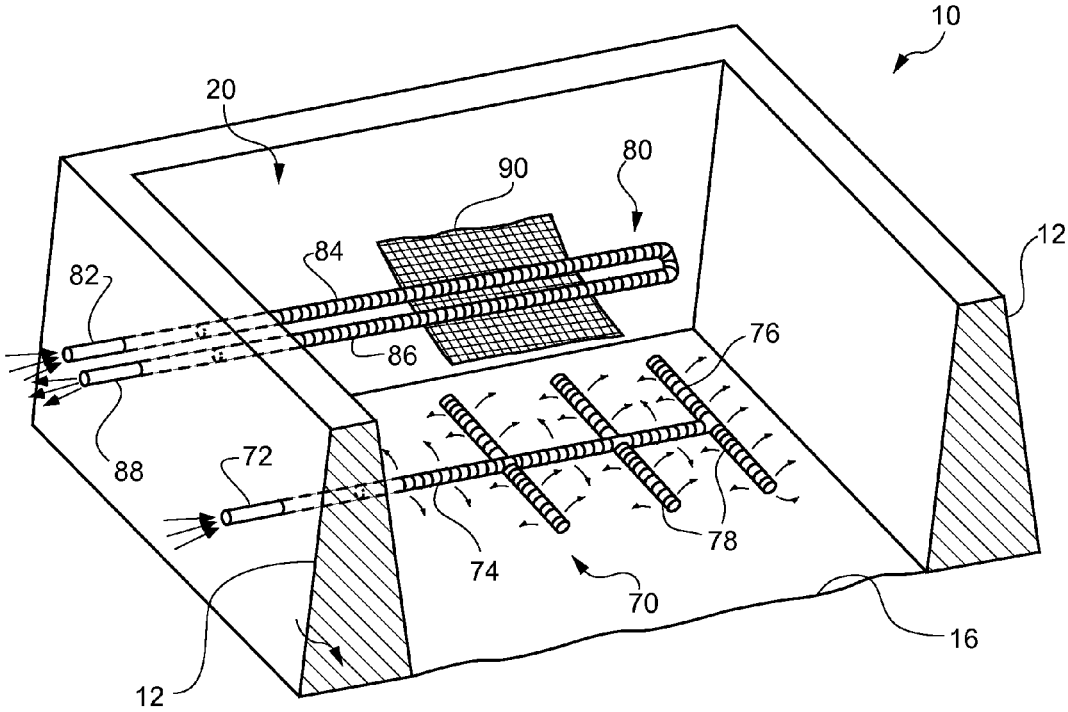
FIG. 3 illustrates a perspective schematic view of heating conduit with corrugated walls buried within the permeable body (not shown for clarity purposes), in accordance with additional embodiments.

Various configurations for the heating conduit are generally illustrated in FIG. 3, in which the heating conduit is buried inside permeable body of the hydrocarbonaceous material (not shown) enclosed within the containment capsule 20 further defined by the side walls 12, the impermeable floor layer 16 and the impermeable cap layer (not shown), and in which the conduit can be embedded in the permeable body 30 contemporaneous with filling the control infrastructure 10 with hydrocarbonaceous material 32. With embodiment 70, for example, the heating conduit can be configured as a one-directional conduit with open apertures 78 to allow the heat transfer fluid to directly enter and convectively mix, heat and react throughout the permeable body. The open system can have an inlet end 72 extending from the boundary of the constructed permeability control infrastructure that is operably coupled to the heat source of the heat transfer fluid. (see FIG. 1). Inside the control infrastructure 10 the heating conduit 70 can have a variety of heating network configurations, include conduit mains 74 and side branches 76. Both the mains and the branches can have open apertures 78 that allow the heat transfer fluid to pass direction in the permeable body. This configuration would also work well for collection conduits to draw liquid hydrocarbon product from lower regions of the permeable body.

Alternatively, a heating conduit 80 can be configured as a closed loop that acts to segregate the heat transfer fluid from the permeable body and to establish thermal conduction across the conduit walls followed by convection of such heat as the primary mechanism for heating the permeable body. The closed system can also have an inlet end 82 extending from the boundary of the constructed permeability control infrastructure and which is operably coupled to the heat source of the heat transfer fluid. However, once inside the control infrastructure 10 the heating conduit 80 can include inlet mains 84 and return mains 86 that are connected with one or more closed loops, and which serve to keep separate the hydrocarbonaceous material and heat transfer fluid, and to direct all the heat transfer fluid back out of a return end 88 that also extends from the side wall 12 of the impoundment.

Further shown in FIG. 3 is an optional metallic mesh 90 or similar structure that can be positioned below a portion of the heating conduit to maintain the relative position of the heating conduit within the permeable body. Although it has been observed that the permeable body of hydrocarbonaceous material can experience significant settling, the concentrated weight of the heating conduit in combination with the high flux of heat immediately adjacent the conduit can cause the pipe to settle or subside even faster than the permeable body as a whole. In an effort to mitigate some of the harmful and damaging effects of subsidence, the metallic mesh 90 can serve to distribute the weight of the heating conduit across a broader portion of the permeable body and to maintain the relative position of the heating conduit within the permeable body.

Figure 4A:
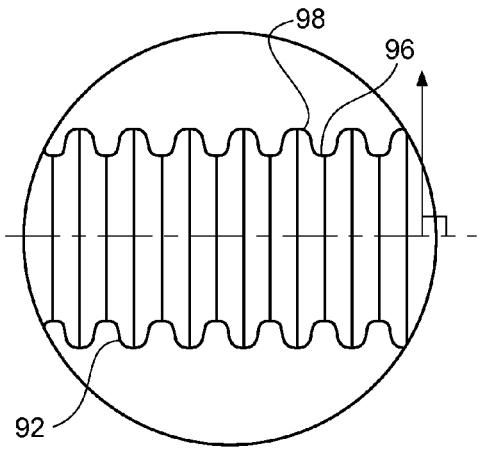
FIGS. 4*a* and 4*b* illustrate side views of heating conduit with corrugated walls, in accordance with additional embodiments.
Figure 4B:
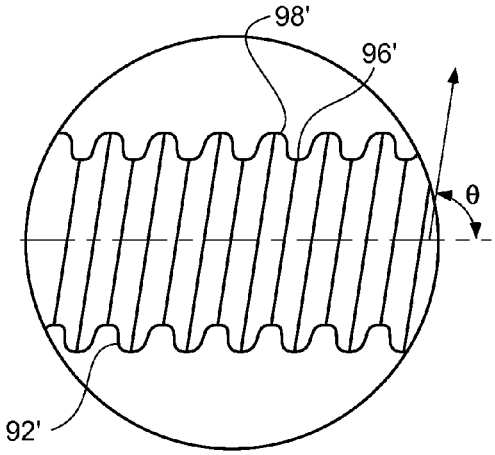

As will be discussed in more detail below, the harmful and damaging effects of subsidence can be further mitigated by forming the walls of the heating conduits with circumferential corrugations 92 and 92', as illustrated in FIGS. 4*a* and 4*b*, to help absorb the sagging and bending created by vertical movement. Advantageously, the corrugations 92 and 92' can also minimize longitudinal axis thermal expansion of the piping by configuring the walls of the heating conduit to also grow or incline radially, rather than solely axially, when the temperature of the heating conduit walls is raised several hundred degrees through direct contact with the heated heat transfer fluid.

In one aspect, the corrugations 92 can follow a continuously-repeating sinusoidal pattern of smoothly-curved troughs 96 and peaks 98 as shown. In other aspects the corrugations can have different shapes, such as flats at the tops of the peaks and bottoms of the troughs, or linear walls for the transition surfaces, or brief sections of smooth, straight pipe between corrugations, etc. Furthermore, the corrugations 92 can be aligned perpendicular to the longitudinal axis of the heating conduit (FIG. 4*a*), or the corrugations 92' can be spiral wound at an acute angle θ relative to the longitudinal axis (FIG. 4*b*). The amplitude of the corrugations (the distance between 96 and 98) and the period (the distance between adjacent peaks 98) can be preconfigured to provide the optimum flexibility and durability throughout the range of temperatures and subsidence experienced by the heating conduit.

The amplitude and period of corrugations also provide the significant added benefit of substantially increasing the surface area available for heat transfer.

The corrugated heating conduit can be formed from a sheet of corrugated metal that has been crimped, rolled and then welded along a longitudinal seam to form a tubular conduit segment. The tubular segments can then be used as-is or welded end-to-end to other segments to form extended heating conduit. Alternatively, the corrugated metal sheets can be continuously spirally-welded together around and along the longitudinal length of pipe, so that no seam in the conduit wall is continuously parallel with or perpendicular to the centerline longitudinal axis of the conduit. Such corrugated conduit manufacture can be optionally done on-site with portable equipment.

Figure 5A:
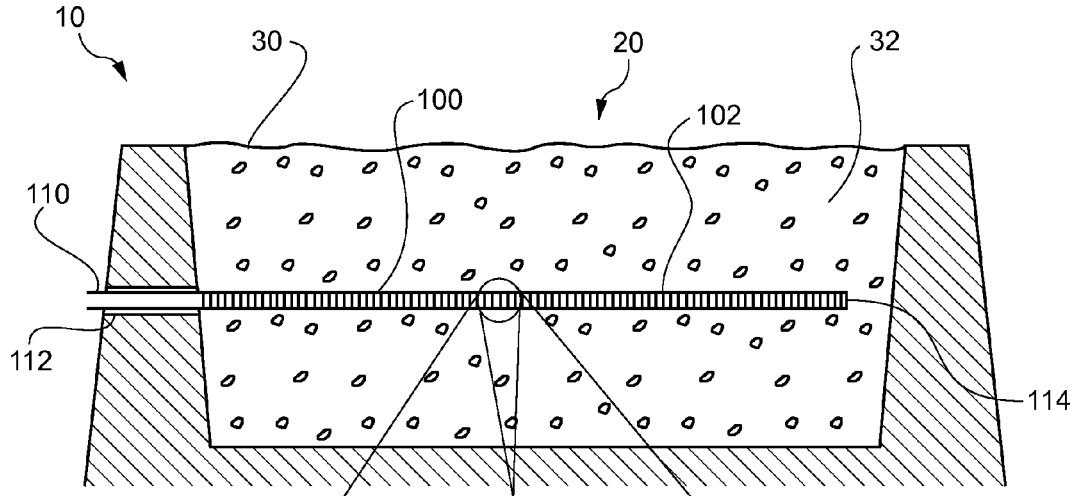
FIG. 5*a* illustrates a side sectional view of heating conduit with corrugated walls buried within the permeable body; in accordance with another embodiment.
Figure 5B:
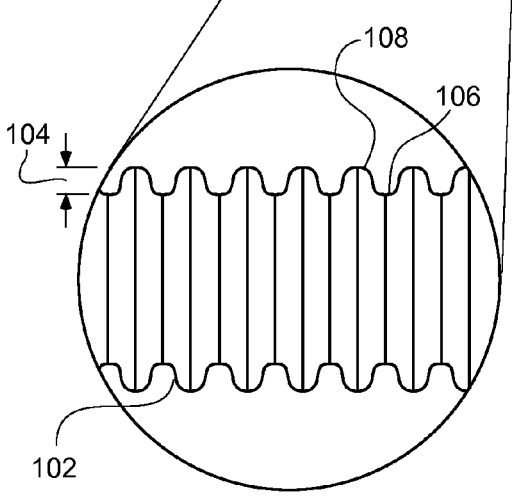
FIGS. 5*b* and 5*c* illustrate close-up side views of the heating conduit of FIG. 5*a;*
Figure 5C:
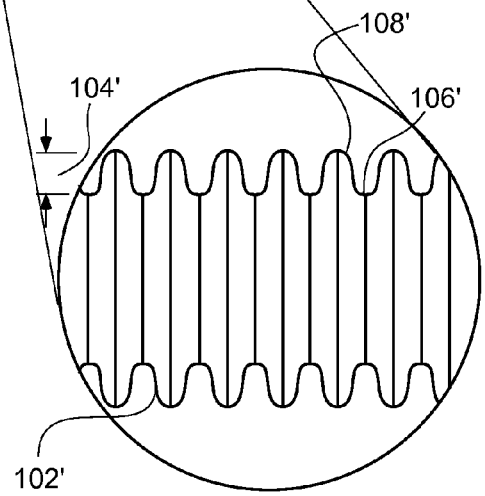

The thermal expansion mitigation benefits of the corrugated conduit are illustrated in more detail in FIGS. 5*a*-5*c*, in which an exemplary segment of heating conduit 100 has been buried at a depth within a permeable body 30 of hydrocarbonaceous material 32, that is in turn enclosed within the containment capsule 20 of a constructed permeability control infrastructure 10. The conduit segment can include an inlet end 110 that extends beyond the boundary of the control infrastructure 10 and is operably coupled to a heat source that is located outside of the control infrastructure. That heating conduit can be surrounded with an optional insulating barrier 112 as it passes through the containment side wall.

As shown in FIG. 5*a*, conduit segment 100 can be buried at a depth within the permeable body 30. Like any heated pipe or conduit, when the temperature of the walls of conduit segment 100 is increased, the overall length of the segment will increase proportionately if the conduit is free to move or expand at one or both ends. The movement is in response to the internal stresses caused by from the expansion of the conduit material. The degree of expansion, of course, depends on the thermal expansion coefficients for that material (e.g. both linear and volumetric coefficients of expansion). However, the mined hydrocarbonaceous material 32 forming the permeable body 30 can have a comminuted, particulate form that can "grab" the walls of the heating conduit and hinder any motion, especially if the permeable body has been built up above the conduit to generate a weight along the length of the buried structure that is sufficient to restrain any stress-relieving movement of the conduit. This effect can increase as the length of the conduit increases. Additionally, the hydrocarbonaceous material 32 located in front of the tip, bend, or free end 114 of the conduit segment can also act to blunt any stress-relieving forward motion, and may cause the tip, bend or free end to be bent or crushed as a result. Consequently, the sidewalls and joints of the heating conduit segment 100 can be subjected to a harmful and damaging build-up of stresses during heating operations, which could lead to the buckling and rupture of the heating conduit if left unaddressed.

To overcome these issues, the conduit segment 100 can be formed with periodic circumferential corrugations 102 in the walls of the conduit comprised of alternating troughs 106 and peaks 108 that have been configured with amplitude 104 in a non-heated environment. As stated above, once placed in a heated environment the length of the corrugated conduit will attempt to increase or grow in the longitudinal or axial direction as a result of linear thermal expansion. If the conduit segment is fixed along its length, however, and that increase is blocked or restrained, the corrugations 102 can allow the longitudinal expansion to be at least partially redirected and absorbed at the individual corrugations and/or increased bending at the peaks 108 and troughs 106. Instead of a large increase in the overall length of the conduit segment, there can be a relatively small increase in the amplitude 104' of each corrugation (which increase in amplitude has been exaggerated in FIG. 5*c*), and which may be accompanied by a corresponding decrease in the radius of curvature (or increased bending) at each bend. Thus, a corrugated conduit can be configured to eliminate or reduce the linear thermal expansion, or at least reduce the compressive axial stresses associated with restrained linear thermal expansion, by allowing thermal expansion and/or increased bending at each corrugation instead.

Figure 6A:
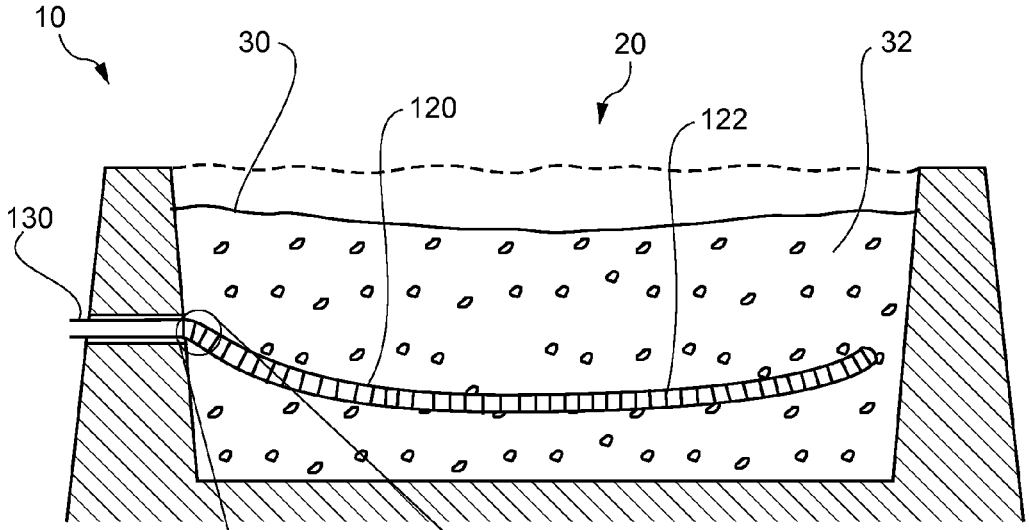
FIG. 6*a* illustrates a side sectional view of heating conduit with corrugated walls buried within the subsiding permeable body; in accordance with another embodiment.
Figure 6B:
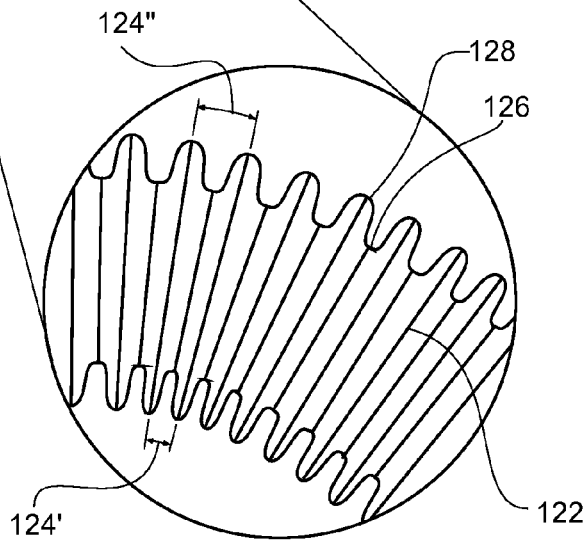
FIG. 6*b* illustrates a close-up side view of the heating conduit of FIG. 6*a;*
Figure 7A:
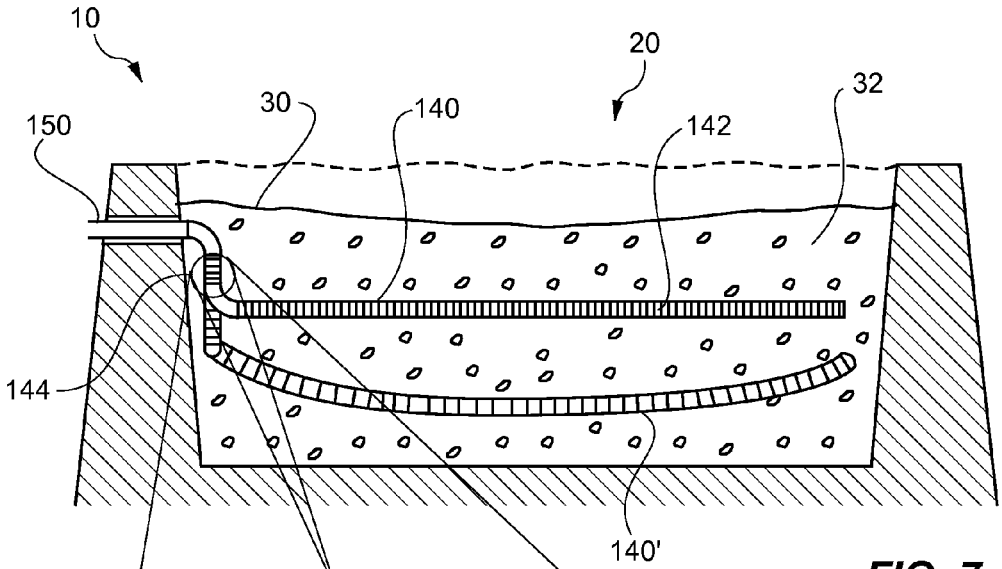
FIG. 7*a* illustrates a side sectional view of heating conduit with corrugated walls buried within the subsiding permeable body; in accordance with another embodiment.
Figure 7B:
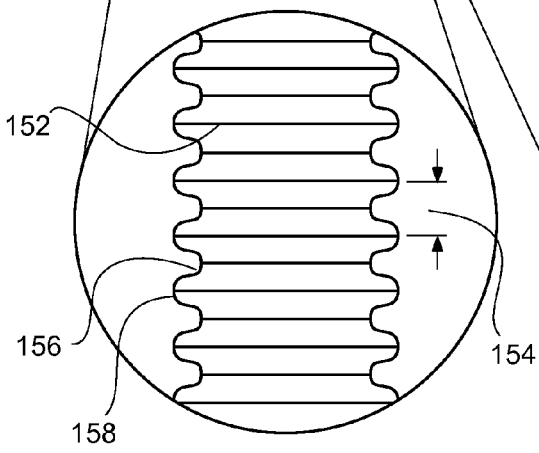
FIGS. 7*b* and 7*c* illustrate close-up side views of the heating conduit of FIG. 7*a*.
Figure 7C:
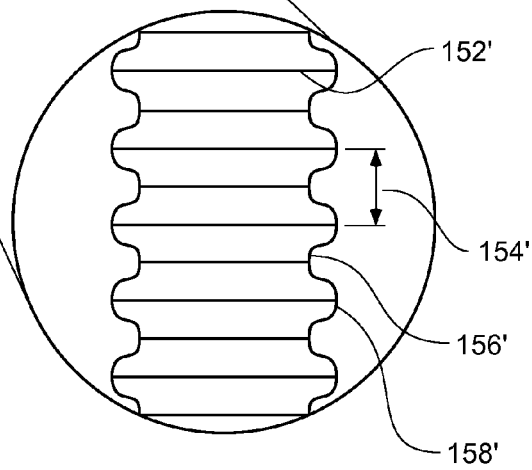

The corrugations can be further beneficial by absorbing the sagging and bending created by the subsidence of the permeable body. As shown in FIGS. 6*a*-6*b*, subsidence of the permeable body 30 can cause the heating conduit segment 120 to be pulled or bent downwards towards the center of the containment capsule 20, even as the conduit attempts to remain attached to the fixed inlet 130. This relative lateral deflection between two segments of the same pipe can result in significant transverse sheer stresses and, if left unaddressed, can cause the heating conduit wall to tear or rupture.

As described above, the heating conduit segment 120 can be formed with periodic circumferential corrugations 122 in the walls of the conduit. The corrugations can be comprised of alternating troughs 126 and peaks 128 that have been configured with a constant period or spacing 124 between adjacent peaks when the conduit segment is positioned in its original straight and un-deflected orientation. As can be seen in FIG. 6*b*, the corrugations 122 can mitigate the subsidence-induced effects experienced by the bent or sagging (e.g., curved) conduit by allowing the normal spacing between adjacent peaks to shrink to a shorter spacing 124' on the inside edge of the curved conduit, and expand to a longer spacing 124" on the outside edge of the curved conduit. With the corrugations configured with sufficient amplitude between troughs and the peaks, the change in spacing can be absorbed with a minor increase in compressive stress in the conduit wall located on the inside edge, and a minor increase in tensile stress in the conduit wall located on the outside edge. With neither stress level being sufficient to reach the material limits of the heating conduit walls, the tearing or rupturing of the heating conduit can be avoided or mitigated.

A variation on the heating conduit embodiments described above is illustrated in FIGS. 7*a*-7*c*, in which the corrugated heating conduit 140 is further configured with a short, vertical segment 144 of corrugated conduit immediately adjacent to the fixed inlet 150 and the containment wall. Like the corrugations 142 in conduit segment 140, the corrugations 152 in this segment are also comprised of alternating troughs 156 and peaks 158, with a constant period or spacing 154 between adjacent peaks. The corrugations 152 in the vertical heating conduit segment 144 may or may not be identical with the corrugations 142 in horizontally-orientated conduit segment 140.

When initially situated within the permeable body, the vertical segment 144 can have an initial length and the horizontal segment 140 can be un-deflected. But as the hydrocarbonaceous material 32 filling the containment capsule 20 begins to heat up, release hydrocarbons and undergo subsidence, the center span of the long, horizontal segment 140' can begin to deflect and bow in response to the vertical movement at the center of the permeable body 30 (see FIG. 2). The subsidence will continue to progress outwards towards the containment walls of the constructed permeability control infrastructure 10, until eventually the portion of the permeable body that surrounds the vertical conduit segment 44 also experiences downward movement. At that point in time the spacing 154 between corrugations 152 can stretch to a new spacing 154' by increasing the radius of curvature (e.g. decreased bending) at the troughs 156 and peaks 158 of each corrugation instead, allowing the vertical segment to extend downwards and follow the motion of the permeable body without experiencing a significant increase in stress in the walls of the heating conduit.

Figure 8:
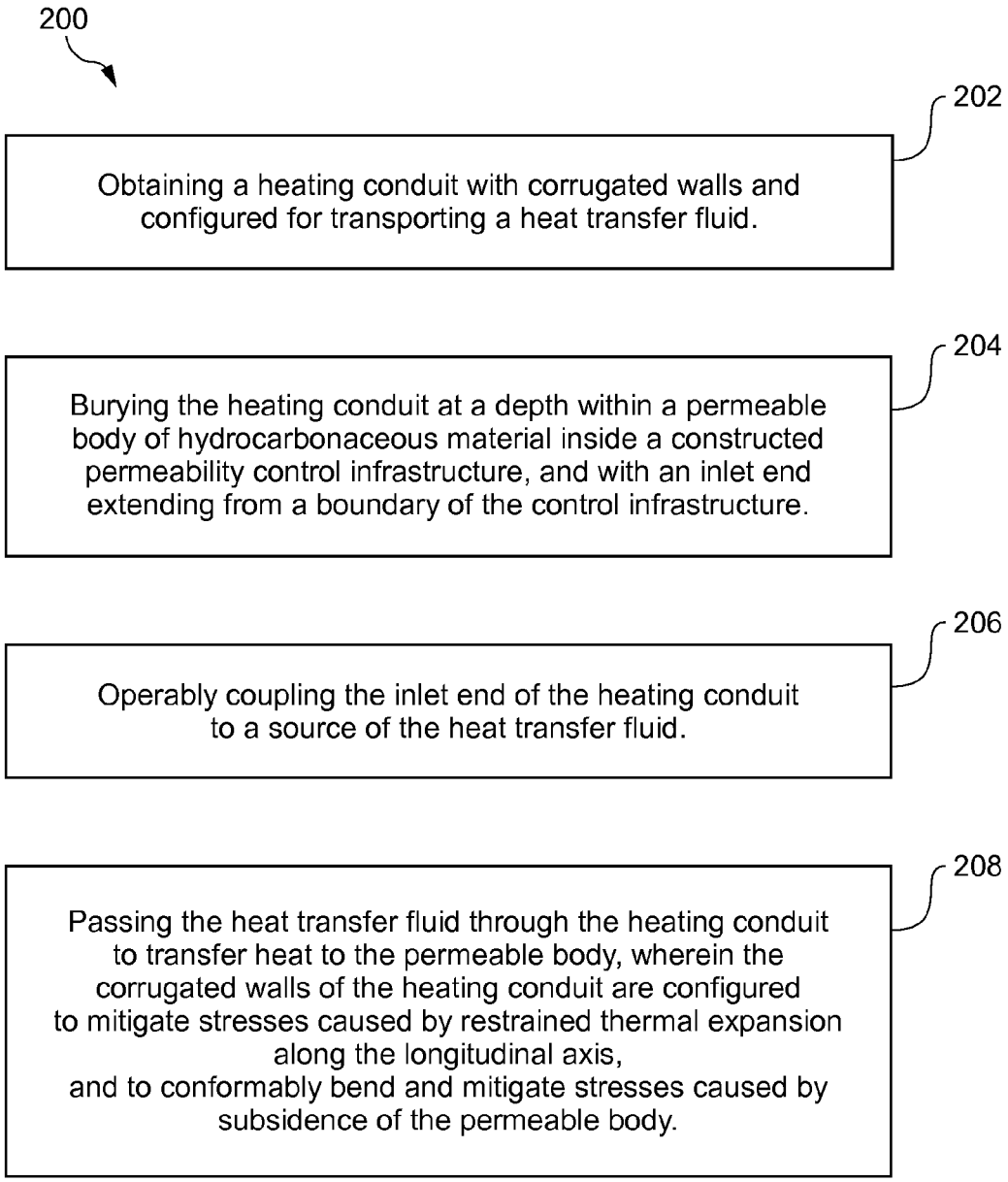
FIG. 8 is a flowchart depicting a method of maintaining the structural integrity of heating conduit used to heat a permeable body of hydrocarbonaceous material contained within a constructed permeability control infrastructure, in accordance with yet another embodiment.

Illustrated in FIG. 8 is a flowchart which depicts a method 200 of maintaining the structural integrity of heating conduit used to heat a permeable body of hydrocarbonaceous material contained within a constructed permeability control infrastructure. The method includes obtaining 202 a heating conduit with corrugated walls and which is configured for transporting a heat transfer fluid. Burying 207 the heating conduit can be performed at a depth within the permeable body of hydrocarbonaceous material contained with a constructed permeability control infrastructure, and with the heating conduit having an inlet end that extends from a boundary of the control infrastructure. The method also includes operably coupling 206 the inlet end of the heating conduit to a source of the heat transfer fluid. The method further includes passing 208 the heat transfer fluid through the heating conduit to transfer heat to the permeable body, wherein the corrugated walls of the heating conduit are configured to expand and mitigate stresses caused by restrained thermal expansion along the longitudinal axis, and further wherein the corrugated walls of the heating conduit are configured to conformably bend and mitigate stresses caused by subsidence of the permeable body.

In summary, the corrugated heating conduit (such as the exemplary embodiments depicted in FIGS. 5*a*, 6*a*, and 7*a*) can substantially mitigate the damaging effects of both the restrained longitudinal thermal expansion of the heating conduit itself as its temperature is increased several hundred degrees, as well as the significant lateral deflections imposed on the heating conduit by the subsequent subsidence of the permeable body. Thus, the heating conduit can function to maintain its structural integrity and continue to apply heat transfer fluid throughout the permeable body for the duration of the heating process.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive Any steps recited in any method or process claims may be executed in any order and are not limited to the order presented in the claims. Accordingly, the scope of the invention should be determined solely by the appended claims and their legal equivalents, rather than by the descriptions and examples given above.

What is claimed and desired to be secured by Letters Patent is:

1. A method of maintaining the structural integrity of heating conduit used to heat a permeable body of hydro carbonaceous material contained within a constructed permeability control infrastructure, comprising:

obtaining a heating conduit with corrugated walls and configured for transporting a heat transfer fluid;

burying the heating conduit at a depth within the permeable body of hydrocarbonaceous material being subject to substantial subsidence of greater than about 10%, the heating conduit having an inlet end extending from a boundary of the constructed permeability control infrastructure;

operably coupling the inlet end of the heating conduit to a source of the heat transfer fluid;

passing the heat transfer fluid through the heating conduit to transfer heat to the permeable body; and facilitating compression of the corrugated walls along a longitudinal axis of the heating conduit to mitigate stresses caused by restrained thermal expansion along the longitudinal axis, and conformable bending of the corrugated walls to mitigate stresses caused by the substantial subsidence of the permeable body.

2. The method of claim 1, further comprising orientating a pattern of transverse corrugations in the corrugated walls perpendicular to the longitudinal axis of the heating conduit.

3. The method of claim 1, further comprising orientating a pattern of transverse corrugations in the corrugated walls at an acute angle relative to the longitudinal axis of the heating conduit.

4. The method of claim 1, further comprising embedding the heating conduit in the permeable body contemporaneous with filling the control infrastructure with hydrocarbonaceous material.

5. The method of claim 1, further comprising orientating at least a portion of the heating conduit substantially horizontally within the permeable body to absorb the effects of subsidence across the longitudinal axis of the heating conduit.

6. The method of claim 1, further comprising orientating at least a portion of the heating conduit substantially vertically within the permeable body to absorb the effects of subsidence along the longitudinal axis of the heating conduit.

7. The method of claim 1, further comprising forming apertures in the corrugated walls in a portion of the heating conduit to allow the heat transfer fluid to enter the permeable body.

8. The method of claim 1, further comprising arranging the heating conduit into a closed loop having a return end extending from the boundary of the constructed permeability control infrastructure, to segregate the heat transfer fluid from the permeable body.

9. The method of claim 1, further comprising selecting the heat transfer fluid from the group consisting of a heated exhaust gas, heated air, steam, hydrocarbon vapors, and a heated liquid.

10. The method of claim 1, further comprising heating the heat transfer fluid to a temperature between 200 degrees and 1000 degrees Fahrenheit.

11. The method of claim 1, further comprising positioning a metallic mesh structure below a portion of the heating conduit buried within the permeable body to maintain the relative position of the heating conduit within the permeable body.

12. A heating conduit system for transferring heat from a heat transfer fluid to a permeable body of hydrocarbonaceous material contained within a constructed permeability control infrastructure, comprising:

a constructed permeability control infrastructure;

a permeable body of hydro carbonaceous material contained within the control infrastructure, the permeable body of hydro carbonaceous material being subject to substantial subsidence of greater than about 10%;

heating conduit buried at a depth within the permeable body and having corrugated walls, being configured for transporting the heat transfer fluid, and having at least one inlet end extending from a boundary of the control infrastructure; and a source of the heat transfer fluid operably coupled to the at least one inlet end, wherein the corrugated walls of at least one portion of the buried heating conduit are configured to axially compress upon passing the heat transfer fluid through the heating conduit to transfer heat to the permeable body, and the corrugated walls of at least one other portion of the buried heating conduit are configured to conformably bend in response to the substantial subsidence of the permeable body.

13. The conduit system of claim 12, wherein a pattern of transverse corrugations in the corrugated walls is oriented perpendicular to the longitudinal axis of the heating conduit.

14. The conduit system of claim 12, wherein a pattern of transverse corrugations in the corrugated walls is orientated at an acute angle relative to the longitudinal axis of the heating conduit.

15. The conduit system of claim 12, wherein at least a portion of the heating conduit is orientated substantially horizontally within the permeable body to absorb the effects of subsidence across the longitudinal axis of the heating conduit.

16. The conduit system of claim 12, wherein at least a portion of the heating conduit is orientated substantially vertically within the permeable body to absorb the effects of subsidence along the longitudinal axis of the heating conduit.

17. The conduit system of claim 12, further comprising at least a portion of the heating conduit having apertures formed in the corrugated walls to allow the heat transfer fluid to enter the permeable body.

18. The conduit system of claim 12, further comprising the heating conduit being formed into a closed loop having a return end extending from the boundary of the constructed permeability control infrastructure, to segregate the heat transfer fluid from the permeable body.

19. The conduit system of claim 12, wherein the heat transfer fluid is selected from the group consisting of a heated exhaust gas, heated air, steam, hydrocarbon vapors, and a heated liquid.

20. The conduit system of claim 12, wherein the heat transfer fluid is heated to a temperature between 200 degrees and 900 degrees Fahrenheit.

21. The conduit system of claim 12, further comprising a metallic mesh structure positioned below a portion of the heating conduit buried within the permeable body to maintain the relative position of the heating conduit within the permeable body.

* * * * *